US006311035B1

(12) United States Patent
Liu et al.

(10) Patent No.: US 6,311,035 B1
(45) Date of Patent: Oct. 30, 2001

(54) REPROGRAPHIC SYSTEM OPERABLE FOR DIRECT TRANSFER OF A DEVELOPED IMAGE FROM AN IMAGING MEMBER TO A COPY SUBSTRATE

(75) Inventors: Chu-heng Liu, Penfield; Rodney B. Proulx, Webster, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/596,143

(22) Filed: Jun. 16, 2000

(51) Int. Cl.[7] ..... G03G 15/10; G03G 17/08

(52) U.S. Cl. ..... 399/240; 399/133

(58) Field of Search ..... 399/285, 237, 399/238, 239, 240, 130, 133, 154

(56) References Cited

U.S. PATENT DOCUMENTS

| | | | | |
|---|---|---|---|---|
| 3,729,419 | | 4/1973 | Honjo et al. | 430/115 |
| 3,841,893 | | 10/1974 | Honjo et al. | 430/119 |
| 3,847,478 | | 11/1974 | Young . | |
| 3,923,392 | * | 12/1975 | Buchan et al. . | |
| 3,968,044 | | 7/1976 | Tamai et al. | 430/106 |
| 4,476,210 | | 10/1984 | Croucher et al. | 430/114 |
| 4,504,138 | | 3/1985 | Kuehnle et al. . | |
| 4,707,429 | | 11/1987 | Trout | 430/115 |
| 4,748,474 | * | 5/1988 | Kurematsu et al. . | |
| 4,762,764 | | 8/1988 | Ng et al. | 430/115 |
| 4,794,651 | | 12/1988 | Landa et al. | 430/110 |
| 5,223,368 | | 6/1993 | Ciccarelli et al. | 430/110 |
| 5,436,706 | | 7/1995 | Landa et al. . | |
| 5,451,483 | | 9/1995 | Fuller et al. | 430/114 |
| 5,484,670 | | 1/1996 | Angell et al. | 429/199 |
| 5,596,396 | | 1/1997 | Landa et al. | 399/237 |
| 5,610,694 | * | 3/1997 | Lior et al. | 399/240 |
| 5,619,313 | | 4/1997 | Domoto et al. | 399/233 |
| 5,826,147 | | 10/1998 | Liu et al. | 399/237 |
| 5,937,243 | * | 8/1999 | Liu et al. | 399/130 |
| 5,966,570 | * | 10/1999 | Till et al. | 399/133 |
| 5,987,283 | * | 11/1999 | Zhao et al. | 399/237 |
| 6,122,471 | * | 9/2000 | Liu et al. | 399/237 |

* cited by examiner

*Primary Examiner*—Susan S.Y. Lee
(74) *Attorney, Agent, or Firm*—Mark Z. Dudley

(57) ABSTRACT

An imaging system for effecting electrostatic printing of an image, wherein the imaging system includes at least one contact electrostatic printing engine operable in a novel fashion upon a copy substrate, wherein the contact electrostatic printing engine images and develops an electrostatic latent image representative of the image on an imaging member, and subsequently transfers the developed image from the imaging member to the copy substrate in a direct adhesive transfer step.

12 Claims, 4 Drawing Sheets

REPROGRAPHIC SYSTEM OPERABLE FOR DIRECT TRANSFER OF A DEVELOPED IMAGE FROM AN IMAGING MEMBER TO A COPY SUBSTRATE

CROSS-REFERENCE TO RELATED APPLICATIONS

This application is related to U.S. patent application Ser. No. 09/457,456, entitled METHOD AND APPARATUS FOR DELIVERY OF HIGH SOLIDS CONTENT TONER CAKE IN A CONTACT ELECTROSTATIC PRINTING SYSTEM, filed on Dec. 8, 1999, in the names of Chu-heng Liu, Weizhong Zhao, and Paul W. Morehouse, Jr.; and U.S. patent application Ser. No. 09/525,344, entitled TONER CAKE DELIVERY SYSTEM HAVING A CARRIER FLUID SEPARATION SURFACE, filed on Mar. 13, 2000 in the name of Chu-heng Liu, the disclosures of which are included herein by reference.

FIELD OF THE INVENTION

This invention relates generally to latent image development systems, and, more particularly, relates to an imaging system for contact electrostatic development of a latent image, wherein the latent image is developed on an imaging member, and wherein the developed image is transferred directly from the imaging member to a copy substrate in a single adhesive transfer step.

BACKGROUND OF THE INVENTION

A typical electrostatographic printing process includes a development step whereby developing material, including toner or marking particles, is physically transported into the vicinity of a latent image, with the toner or marking particles being caused to migrate via electrical attraction to the image areas of the latent image so as to selectively adhere in an imaged configuration. Transfer of the developed image to a copy substrate typically occurs either by an electrostatic transfer technique or an adhesive transfer technique.

Adhesive transfer of the developed image to a copy substrate is advantageous for a broad range of substrates; however, it requires an application of high pressure and high temperature at the interface of the developed image and the copy substrate. In conventional electrophotographic systems, adhesive transfer is typically implemented after the developed image is transferred to an intermediate transfer member. Direct transfer from the imaging member, upon which the developed image is first formed, is typically not considered because the imaging member lacks the requisite compliance and the appropriate surface characteristics for successful adhesive transfer of the developed image directly to a copy substrate.

An example of a conventional approach may be found in U.S. Pat. No. 5,436,706, issued to Landa, wherein there is disclosed an intermediate transfer member which is in operative engagement with a photoconductive surface of a drum bearing the developed image. The intermediate transfer member is said to be operative for receiving the toner image from a photoconductive surface and for transferring the toner image to a final substrate. A heater to heat the intermediate transfer member may also be provided. Transfer of the image to the intermediate transfer member is said to be aided by providing an electric field between the intermediate transfer member and the image areas of the photoconductive surface. The intermediate transfer member is said to include a conducting layer underlying an elastomeric layer.

However, it is desirable that the developed image be directly transferable from an imaging member to a wide range of substrates. Direct, singlestep image transfer, that is, the transfer of the developed image from the imaging member upon which the developed image was first formed, incurs less of the image quality loss that is associated with conventional development and transfer techniques, such as those that employ an intermediate transfer member, additional bias, or an electrostatically-enabled transfer step.

SUMMARY OF THE INVENTION

An imaging system may be constructed according to the present invention for effecting contact electrostatic printing of an image onto a copy substrate. The imaging system includes at least one contact electrostatic printing engine, having a latent image carrier member that includes a latent image bearing surface for receiving a latent image; an imaging member having a developed image bearing surface; and a toner cake layer delivery apparatus operative for delivery of a toner cake layer to at least one of the developed image bearing surface and the latent image bearing surface. Subsequent engagement of the developed image bearing surface and the latent image bearing surface causes development of the latent image, wherein the toner cake layer is separated, in correspondence with the image and non-image regions of the latent image, into a developed image borne on the developed image bearing surface. The remainder of the toner cake layer lies on the latent image bearing surface. Subsequent engagement of the developed image bearing surface with a copy substrate allows direct transfer therefrom of the developed image to the copy substrate, wherein transfer of the developed image is provided in a single image transfer step.

For example, the toner cake layer delivery apparatus may be operative for delivery of a toner cake layer to the developed image bearing surface and the development step may occur as the toner cake layer is brought into pressure contact with the latent image bearing surface of the latent image carrier member, such that a developed image is created on the developed image bearing surface of the imaging member by separation of the toner cake layer, wherein selective portions of the toner cake layer are retained on the developed image bearing surface in correspondence with the image, and wherein non-image regions transfer to the latent image carrier member.

Alternatively, the latent image carrier member may be uniformly coated with the toner cake layer and charged in an image-wise fashion to create a latent image, whereupon the latent image development step may be carried out as the developed image bearing surface is brought into contact with the latent image bearing surface. The developed image is created on the developed image bearing surface by separation of the toner cake layer, wherein selective portions of the toner cake layer are transferred to the developed image bearing surface in correspondence with the image, and non-image regions remain on the latent image carrier member.

In accordance with a principal aspect of the present invention, the imaging member preferably includes a developed image bearing surface constructed to exhibit at least one of the following surface characteristics: substantial conformability, low surface energy, and electrical conductivity.

"Substantial conformability", in reference to a surface characteristic of the developed image bearing surface, describes a surface characteristic of the imaging member wherein a portion of the developed image bearing surface conforms to a portion of the surface of a copy substrate during engagement of the developed image bearing surface with a copy substrate. Such engagement is contemplated as being effected in a transfer nip, wherein a portion of the copy substrate is constrained under pressure between a corresponding portion of the developed image bearing surface and a corresponding, opposing portion of the surface of a pressure resisting member, such as a pressure roller, such that the portion of the developed image thus constrained is subjected to substantially complete contact with the copy substrate, that is, contact without substantial voids or interfacial gaps. Such engagement may be accompanied by an application of thermal or acoustic energy so as to assist in the adhesive transfer step.

As a result, there is substantially complete adhesive transfer of the developed image in a single adhesive transfer step, and is useful for transfer to a copy substrate having surface characteristic(s) that are less than satisfactory for developed image transfer, such as a surface that has surface irregularities, or is rough, textured, porous, etc.

"Direct" and "single", in reference to the adhesive transfer step, describes a process for adhesive transfer of the developed image that obviates the use of an intermediate transfer member for transfer of the developed image from the imaging member to the copy substrate.

The developed image bearing surface is preferably constructed to effect a substantial area of rolling contact with the copy substrate at the interface of the developed image bearing surface and the copy substrate, thus eliminating problems of variable tolerance in the gap between the copy substrate and the developed image bearing surface. Such a developed image bearing surface offers improved contact with the surface irregularities typically found in a wide range of copy substrate materials.

Accordingly, in certain applications of the present invention, the thickness of the toner cake layer present on the developed image bearing surface may be substantially less than the amplitude of the surface irregularities of the copy substrate.

"Low surface energy", in reference to a surface characteristic of the developed image bearing surface, describes a surface characteristic wherein the surface energy of the developed image bearing surface promotes complete adhesive transfer of the developed image to the copy substrate. A preferred embodiment of the developed image bearing surface exhibits a surface energy in the range of 30 dynes/$cm^2$ or less.

"Electrical conductivity", in reference to a surface characteristic of the developed image bearing surface, describes electrical characteristic distinguishable, according to teachings known in the art, from a dielectric or electrically insulating surface.

In accordance with another aspect of the present invention, "adhesive transfer" of the developed image refers to the transfer of the developed image according to an optimization of the following variables, which are preferably optimized for high transfer efficiency: A1 (representing the extent of adhesion of the developed image to the developed image bearing surface); C (representing the extent of cohesion of the developed image, wherein cohesion of the developed image minimizes shearing or splitting of the developed image); and A2 (representing the extent of adhesion of the developed image to the copy substrate).

One preferred optimization of the adhesive transfer may be achieved according to the following relationship:

$$A1<C<A2 \quad \text{(Eq.1)}$$

In accordance with another aspect of the present invention, adhesive transfer of the developed image is enhanced by use of a thin, uniform toner cake layer of high solids content. The desired toner cake layer is generally characterized as having a high solids content (e.g., approximately 10–50 percent solids, and preferably in the range of approximately 15 to 35 percent solids, or greater), and exhibits the additional advantageous characteristics of a uniform thickness, in the range of 1–15 microns, and an accurately metered mass per unit area on the order of 0.1 mg per $cm^2$.

Accordingly, a first embodiment of a novel contact electrostatic printing engine may be constructed to include a photosensitive latent image carrier member which is rotated so as to transport the surface thereof in a process direction for implementing steps for charging and imaged exposure of a light image corresponding to the desired component image. A second movable member in the form of a toner cake layer applicator is provided in combination with a toner cake delivery apparatus, the latter including a supply of low solids content liquid developing material, generally made up of toner particles immersed in a liquid carrier material. The toner cake layer is transferred to a third movable member in the form of an imaging member having a developed image bearing surface, by transporting the toner cake layer through a nip formed by the operative engagement of the toner cake layer applicator and the developed image bearing surface. By further rotation of the imaging member and engagement with the latent image carrier member, a development step then occurs, producing a developed image made up of selectively separated portions of the toner cake layer on the developed image bearing surface of the imaging member, while leaving background image byproduct on the surface of the latent image carrier member. Adhesive transfer of the developed image from the developed image bearing surface to a copy substrate may then be accomplished. Accordingly, the developed image bearing surface may be optimized for adhesive transfer, and for transfixing the developed image by application of an elevated temperature and pressure during the transfer step.

In accordance with another aspect of the present invention, a second embodiment of a contact electrostatic printing engine may be constructed to include a latent image carrier member for receiving an electrostatic latent image. An exposure device is also provided for generating a primary electrostatic latent image on the surface on the latent image carrier member, wherein the electrostatic latent image includes image areas defined by a first charge voltage and non-image areas defined by a second charge voltage distinguishable from the first charge voltage. The aforementioned toner cake delivery apparatus is provided for depositing the toner cake layer on the surface of the latent image carrier member so as to form a layer of high solids content marking material that is adjacent the primary electrostatic latent image. In addition, a charge source is provided for selectively delivering charges to the toner cake layer in a pattern corresponding to the primary electrostatic latent image, so as to form a secondary latent image in the toner cake layer. The secondary latent image includes image and non-image areas corresponding to the primary electrostatic latent image. An imaging member having a developed image bearing surface is rotated for engagement with the latent image carrier member and thereby for selectively receiving portions of the toner cake layer in accordance with the secondary latent image. A developed image corresponding to the secondary electrostatic latent image is thereby formed on the imaging member. Adhesive transfer of the developed image from the developed image bearing surface to a copy substrate may then be accomplished.

In accordance with another aspect of the present invention, a third embodiment of a contact electrostatic printing engine may be constructed to include a latent image carrier member for receiving an electrostatic latent image. An exposure device is also provided for generating a primary electrostatic latent image on the surface on the latent image carrier member, wherein the electrostatic latent image includes image areas defined by a first charge voltage and non-image areas defined by a second charge voltage distinguishable from the first charge voltage. The aforementioned toner cake delivery apparatus is provided for depositing the toner cake layer on the surface of the latent image carrier member so as to form a layer of high solids content marking material that is adjacent the primary electrostatic latent image. In addition, a charge source is provided for selectively delivering charges to the toner cake layer in a pattern corresponding to the primary electrostatic latent image, so as to form a secondary latent image in the toner cake layer and means are provided for inducing air breakdown in the vicinity of the toner cake layer so as to better create the secondary latent image. The secondary latent image includes image and non-image areas corresponding to the primary electrostatic latent image. An imaging member having a developed image bearing surface is rotated for engagement with the latent image carrier member and thereby for selectively receiving portions of the toner cake layer in accordance with the secondary latent image. A developed image corresponding to the secondary electrostatic latent image is thereby formed on the imaging member. Adhesive transfer of the developed image from the developed image bearing surface to a copy substrate may then be accomplished.

In accordance with another aspect of the present invention, a fourth embodiment of a contact electrostatic printing engine may be constructed to include a latent image carrier member for receiving an electrostatic latent image. The aforementioned toner cake delivery apparatus is provided for depositing the toner cake layer on the surface of the latent image carrier member so as to form a layer of high solids content marking material that is adjacent the electrostatic latent image. In addition, an ionographic source is provided for selectively delivering charges to the toner cake layer in a pattern corresponding to the primary electrostatic latent image, so as to form a secondary latent image in the toner cake layer. The latent image includes image and non-image areas corresponding to the primary electrostatic latent image. An imaging member is rotated for engagement with the latent image carrier member and for selectively receiving portions of the toner cake layer in accordance with the secondary latent image. A developed image corresponding to the secondary electrostatic latent image is thereby formed on the imaging member. Adhesive transfer of the developed image from the developed image bearing surface to a copy substrate may then be accomplished.

BRIEF DESCRIPTION OF THE DRAWINGS

The foregoing and other aspects of the present invention will become apparent from the following description in conjunction with the accompanying drawings wherein like reference numerals have been used throughout to identify identical or similar elements. The following figures provide simplified schematic representations of apparatus constructed according to the present invention for use in a contact electrostatic printing (CEP) system. The illustrated contact electrostatic printing (CEP) engines may therefore be employed for imaging and developing an electrostatic latent image that corresponds to a desired image, wherein a layer of highly concentrated toner cake is used for development of the latent image, with subsequent direct transfer of the developed image onto a copy substrate, thereby providing an output image on the copy substrate.

DETAILED DESCRIPTION OF THE EMBODIMENTS

Figure 1:
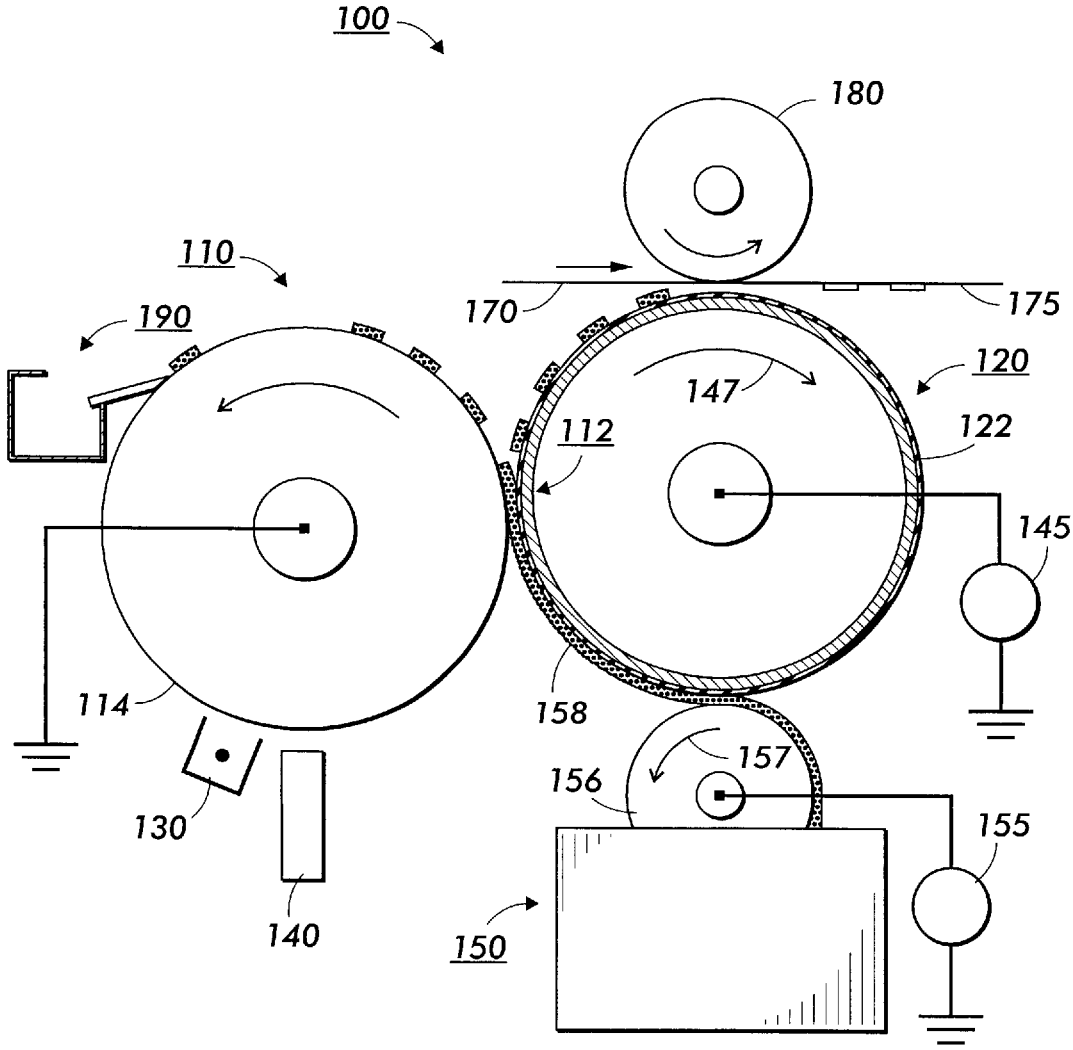
FIG. 1 is an elevational view schematically depicting a first embodiment of a CEP engine constructed for imaging and development of an electrostatic latent image on an imaging member.

Of particular interest with respect to the present invention is the concept of forming a concentrated layer of developing material on a first surface of a first member, wherein the developing material layer has a high concentration of charged marking particles. The developing material layer on the first member is brought into contact with an electrostatic latent image on a second surface of a second member, wherein development of the latent image occurs upon separation of the first and second surfaces, as a function of the electric field strength generated by the latent image. In this process, marking particle migration or electrophoresis is replaced by direct surface-to-surface transfer of the developing material layer induced by imaged fields.

For the purposes of the present description, the concept of latent image development via direct surface-to-surface transfer of a developing material layer via imaged fields will be identified generally as contact electrostatic printing (CEP). Exemplary patents which may describe certain general aspects of contact electrostatic printing, as well as specific apparatus therefor, may be found in U.S. Pat. Nos. 4,504,138; 5,436,706; 5,596,396; 5,610,694; and 5,619,313.

The present invention is accordingly directed to an imaging system wherein latent image development is carried out via direct surface-to-surface transfer of a highly concentrated toner cake layer, utilizing imaged electrostatic forces to lo separate the layer of toner cake into image and non-image regions, regardless of where the layer of toner cake is formed prior to image separation or how the image separating electrostatic forces are generated. Although the following description will describe, by example, several embodiments of latent image bearing surfaces in a contact electrostatic printing engine, and related latent imaging processes, it will be understood that the present invention contemplates the use of various alternative latent image bearing surfaces as are well known in the art of electrostatographic printing, including, for example, but not limited to, non-photosensitive surfaces such as a dielectric charge retaining surface of the type used in ionographic printing machines, or electrode substructures in surfaces capable of generating charged latent images.

The highly concentrated toner cake layer described herein is derived from a supply of low solids content liquid developing material. In general terms, such a toner cake layer is first presented in the form of a thin uniform layer of marking material that is supported on a first surface which is brought into pressure contact with a second surface at a development nip formed therebetween. The toner cake layer is exposed to at least two stresses: a compressive stress in the nip as well as at the entrance thereof; and a tensile stress at the nip exit as the developed image is separated into image areas on one surface and background areas on the other surface. In order to optimize the resultant image quality, it is desirable that the toner cake layer have sufficient yield stress to allow the toner particles therein to maintain their integrity while being exposed to these particular stress forces. Thus, pre-selecting materials having a particular yield stress and selectively varying the yield stress of a given toner cake layer can be particularly useful in defining operational parameters for optimization of the contact electrostatic printing process.

Additionally, the contact electrostatic printing process of the present invention may include development of an electrostatic latent image on an image support using supply limited development techniques, i.e., the developing potential of the latent image is not typically exhausted after being initially developed.

Additionally, the contact electrostatic printing process of the present invention includes limited relative movement between toner particles during and after latent image development, wherein the high solids content of the toner cake layer prevents toner particles from moving relative to each other.

FIG. 1 is an elevational view schematically depicting a first embodiment of a CEP engine 100 constructed for imaging and development of an electrostatic latent image. FIG. 1 accordingly illustrates a toner cake layer delivery apparatus 150, having a toner cake layer applicator 156 on which a thin, uniform toner cake layer 158 of high solids content is created. The toner cake layer 158 is transported into pressure contact with the surface of an imaging member (as will be described below), such that a developed image is created by separating and selectively transferring portions of the toner cake layer in correspondence with the image and non-image regions of a latent image. The toner cake layer delivery apparatus 150 includes a supply of low solids content liquid developing material, which may be characterized as having a percentage of solids content that is less than the percentage of solids content desired in the toner cake layer 158. For example, an approximately 1–10 percent solids content is considered to be characteristic of a low solids content liquid developing material; an approximately 10–50 percent solids content, or greater, and preferably on the order of approximately 15 to 35 percent solids, is considered to be characteristic of the toner cake layer 158. The toner cake layer 158 also preferably exhibits the additional advantageous characteristics of a uniform thickness, selectable from the range of approximately 1–15 microns, and an accurately metered mass per unit area of approximately 0.1 mg per $cm^2$.

It will be understood that, while the toner cake layer applicator 156 is shown and described as being provided in the form of a drum, such members may alternatively be provided in other configurations, such as a continuous flexible belt which is entrained over a series of rollers, and is movable in the same direction as shown, with appropriate modification of the arrangement of the devices that interface to the flexible belt.

The illustrated first embodiment of a contact electrostatic printing engine 100 is adapted for operation with respect to a copy substrate 175 carried on a substrate transfer path 170. The engine 100 is preferably associated with a respective pressure-resisting member such as a pressure roller 180 for direct adhesive transfer of the developed image to the copy substrate 175. An optional fuser assembly (not shown) may be provided for full or final fusing of the developed image when necessary.

A development nip 112 is created between the imaging member 120 and a latent image carrier member 110. The toner cake layer 158, having a high solids content as described hereinabove, is brought into pressure contact with the surface of the latent image carrier member 110, as will be described in detail below, whereby the toner cake layer 158 is separated into image and non-image segments. Image development occurs as a function of surface to surface transfer of an assemblage or aggregate of particles making up a particular section of the toner cake layer as opposed to electrostatic attraction of individual toner particles dispersed in a carrier liquid.

The latent image carrier member 110 includes a latent image bearing surface 114 of any type capable of having an electrostatic latent image formed thereon. An exemplary latent image carrier member 110 may include a typical photoconductive or other photoreceptive component of the type known to those of skill in the art of electrophotography. The latent image carrier member 110 is rotated so as to transport the surface thereof in a process direction 147 for implementing a series of latent image forming steps, as will now be described.

Initially, in the exemplary embodiment of FIG. 1, the latent image bearing surface 114 passes through a charging station, which may include a corona generating device 130 or any other charging apparatus for applying an electrostatic charge to the surface of the imaging member 110. The corona generating device 130 is provided for charging the latent image bearing surface 114 to a relatively high, substantially uniform electrical charge potential. It will be understood that various charging devices, such as charge rollers, charge brushes and the like, as well as inductive and semiconductive charge devices, among other devices which are well known in the art, may be utilized at the charging station for applying a charge potential to the latent image bearing surface 114.

After the latent image carrier member 110 is brought to a substantially uniform charge potential, the charged surface thereof is advanced to an imaging station, identified generally by reference numeral 140. The imaging station 140 may incorporate various latent image projection or formation components as are known in the art, such as one or more known ionic, optical, electro-optical, or digital scanning systems for forming and projecting an image from an original input document onto the imaging member 110. Alternatively, various other latent imaging devices available in the art may be utilized for generating a suitable pattern to create the latent image on the latent image carrier member 110.

Presuming that the illustrated imaging station 140 projects, onto the charged latent image bearing surface 114, a light image corresponding to the desired component image, the electrostatic latent image then comprises, in a latent image configuration corresponding to the desired image information, image areas defined by a first charge voltage potential and non-image areas defined by a second charge voltage potential. The preferred latent image, in the form of an electrostatic latent image, is comprised of image and non-image areas that are defined by regions having opposite charge polarities or by regions having distinguishable first and second voltage potentials which are of the same charge polarity.

The toner cake layer delivery apparatus 150 is adapted to provide a supply of low solids content liquid developing material that is generally made up of toner particles immersed in a liquid carrier material and also typically includes a charge director for providing a mechanism for producing an electrochemical reaction in the liquid developing material composition which generates the desired electrical charge on the toner particles. Generally, the liquid carrier material is present in a large amount in the introductory supply of liquid developing material. The liquid carrier material may be present in an amount of from about 90 to as much as 99.5 percent by weight, although the percentage amount may vary from this range provided that the objectives of the present invention are achieved.

Applicator 156 is rotated in a direction as indicated by arrow 157 for delivering the toner cake layer 158 onto the surface of the imaging member 120. The uniformly distributed toner cake layer 158 is made up of densely packed toner particles in a small percentage of liquid carrier. Depending on the materials utilized in the liquid developing material composition, as well as other process parameters related to the printing system, such as process speed and the like, a toner cake layer having sufficient thickness, preferably between 2 and 15 microns and more preferably on the order of 5 microns or less, is formed on the surface of the imaging member 120 by providing adequate proximity and/or contact pressure between the coating member 156 and the roll surface of imaging member 120. Alternatively, or additionally, an electrical biasing source 155 (or source 255 in FIGS. 2–4) may be coupled to the coating member 156 to assist in electrostatically moving the toner particles onto the surface of the imaging member 120. Thus, in one exemplary embodiment, the coating member 156 can be coupled to an electrical biasing source 155 for implementing a so-called forward biasing scheme, wherein the coating member 156 is provided with an electrical bias of sufficient magnitude and polarity for creating electrical fields extending from the coating member 156 to the surface of the toner cake layer applicator 120. These electrical fields cause toner particles to be substantially uniformly transported to the developed image bearing surface 122 of the imaging member 120, for forming a toner cake layer 158 having a highly concentrated and substantially uniform distribution of toner particles therein.

The imaging member 120 includes a developed image bearing surface 122, a portion of which conforms to the opposing portion of the latent image bearing surface 114 in the development nip 112. When the toner cake layer 158 engages with the latent image bearing surface 114, the toner cake layer 158 is substantially uniformly distributed within the nip created therebetween such that toner particle motion and/or liquid flow is negligible with no distortion being present or induced between the toner particles in the toner cake layer 158.

It will be understood that the presence of the latent image on the latent image carrier member 110 may generate some fringe fields in areas of interface between image and non-image areas of the latent image. However, compared to conventional development, the present invention will substantially eliminate fringe field related image defects due to the solid-like property of the toner cake layer 158 at the entrance of the nip.

An electrical biasing source 145 is coupled to the imaging member 120 for applying an electrical bias thereto so as to generate electrostatic fields between the surface of the imaging member 120 and the image or non-image areas on the surface of the latent image carrier member 110. These electrostatic fields generate fields in opposite directions, in accordance with image and non-image portions of the latent image. Moreover, these fields cause the separation of the image and non-image areas of the toner cake layer 158 upon separation of the imaging member 120 and the latent image carrier member 110 at the exit of development nip 112 for simultaneously separating and developing the toner cake layer 158 into image and non-image portions on the opposed surfaces of the imaging member 120 and the latent image carrier member 110. The developed image is made up of selectively separated and transferred portions of the toner cake layer 158 on the surface of the imaging member 120, while leaving background image byproduct on the surface of the latent image carrier member 110. Development occurs with substantially reduced movement of the toner particles. The development can therefore be implemented at an increased rate to allow high speed processing and improved throughput rates.

This toner cake layer 158 in the development nip 112 is preferably less than 15 microns and more preferably less than 5 microns. The toner cake layer 158 can have a thickness of about 1 micron and still produce acceptable print quality. A development nip gap of less than 5 microns enables development of images of greater than 800 dots per inch (dpi).

The developed image and background are separated at the exit of the development nip 112. The interspersed and contacting developed image area and background toner layers break or snap cleanly at the edge to edge contact. The clean breaking of the edge to edge contact provides for improved edge definition of the developed image relative to prior development systems.

In the illustrated embodiment, continued rotation of the imaging member 120 allows the developed image to be transferred in a single, adhesive transfer step from the developed image bearing surface 122 of the imaging member 120 to a copy substrate 175 carried on the substrate transfer path 170.

(It will be understood that, while the latent image carrier member 110 and the imaging member 120 are each shown and described herein in the form of a drum, such members may each be provided in the alternative form of a continuous flexible belt which is entrained over a series of rollers, and is movable in the same direction as shown.)

Figure 2:
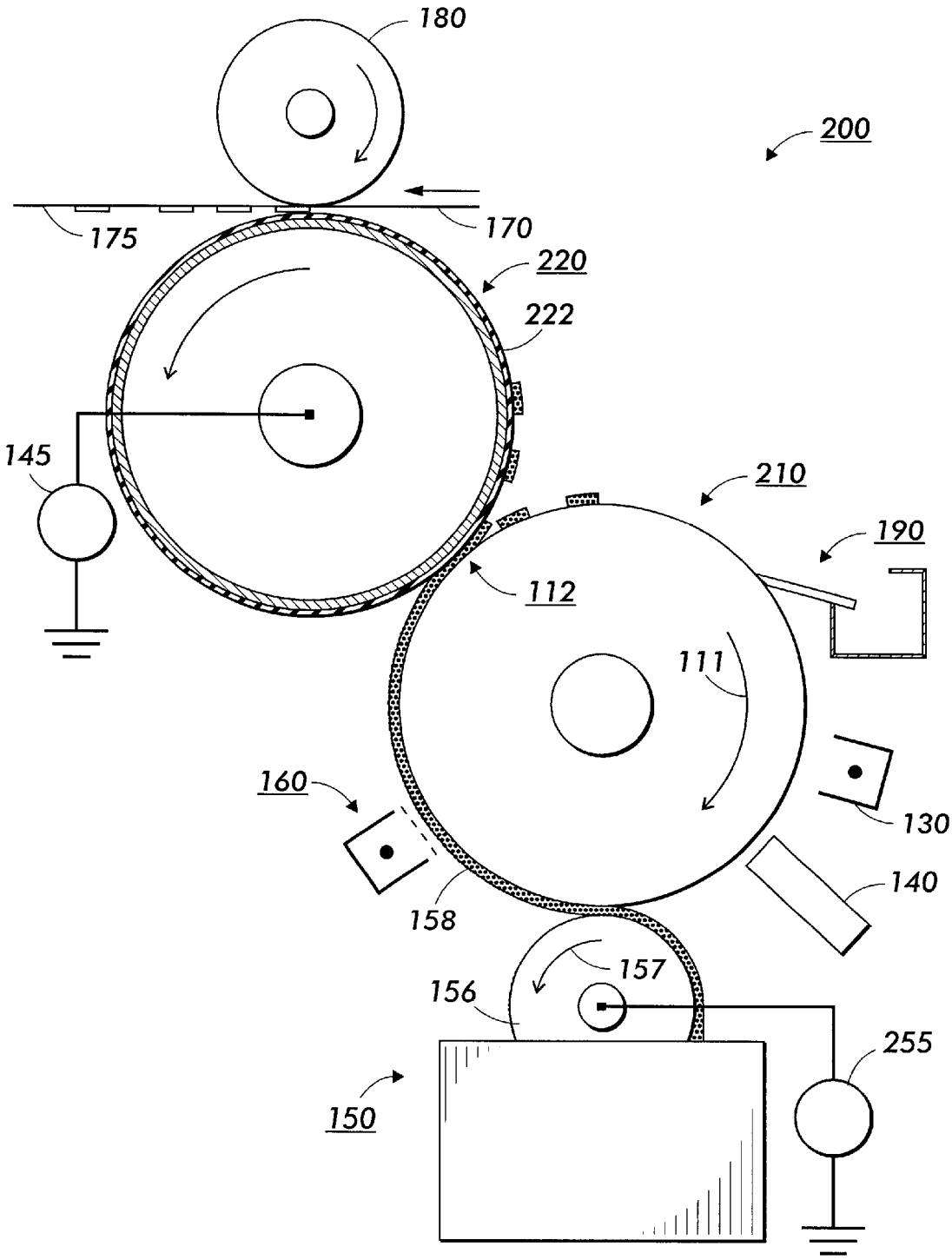
FIG. 2 is an elevational view schematically depicting a second embodiment of a CEP engine constructed for use in a contact electrostatic printing for imaging and development of an electrostatic latent image, wherein a layer of highly concentrated toner cake on a latent image carrier member is selectively charged in a pattern corresponding to an image to create a secondary latent image.

FIG. 2 is an elevational view schematically depicting a second embodiment of a contact electrostatic printing engine 200 constructed for use in imaging and development of an electrostatic latent image, wherein a highly concentrated toner cake layer on latent image carrier member is selectively charged in a pattern corresponding to an image to create a secondary latent image.

As illustrated in FIG. 2, the contact electrostatic printing engine 200 may be constructed for operation in a fashion similar to that described hereinabove with respect to the contact electrostatic printing engine 100, but which is adapted for the formation of a secondary latent image in the toner layer, as will now be described. After the latent image carrier member 210 is brought to a substantially uniform charge potential by the corona generating device 130, the charged surface thereof is advanced to the imaging station 140 so as to generate a primary latent image. After the toner cake layer 158 is formed on the surface of the latent image carrier member 210, the toner cake layer 158 is again charged in a pattern corresponding to an image. An ion source 160 (represented schematically in FIG. 2 as a scorotron device) is provided for introducing free mobile ions in the vicinity of the charged latent image to facilitate the formation of an imaged ion stream extending from the source 160 to the latent image on the surface of the latent image carrier member 210. The imaged ion stream generates a secondary latent image in the toner cake layer 158 made up of oppositely charged toner particles.

The function of the ion source 160 is to charge the toner layer 158 in a pattern corresponding to an image. This process will be described with respect to a negatively charged toner layer, although it will be understood that the process can also be implemented using a positively charged toner layer. In addition, the process of the present invention can also be implemented using an uncharged or neutral toner layer.

The initially charged toner cake layer 158 may now be considered, for purposes of the following description, as a uniformly distributed layer of negatively charged toner particles having the thickness of a single toner particle. As previously described, the primary function of the ion source 160 is to provide free mobile ions in the vicinity of the latent image carrier member 210 having the toner cake layer and latent image thereon. As such, the ion source 160 may be embodied as various known devices, including, but not limited to, any of the variously known corona generating devices available in the art, as well as charging roll type devices, solid state charge devices and electron or ion sources analogous to the type commonly associated with ionographic writing processes.

The preferred ion source 160 includes a corona generating electrode enclosed within a shield member surrounding an electrode on three sides. A wire grid covers the open side of the shield member facing the latent image carrier member 210. In operation, the corona generating electrode, otherwise known as a coronode, is coupled to an electrical biasing source capable of providing a relatively high voltage potential to the coronode, which causes electrostatic fields to develop between the coronode and the grid and the latent image carrier member 210. The force of these fields causes the air immediately surrounding the coronode to become ionized, generating free mobile ions which are repelled from the coronode toward the grid and the latent image carrier member 210. The scorotron grid is biased so as to be operative to control the amount of charge and the charge uniformity applied to the latent image bearing surface of the latent image carrier member 210 by controlling the flow of ions through the electrical field formed between the grid and the latent image bearing surface.

Accordingly, the ion source 160 is operated to provide ions having a charge opposite the charge polarity of the toner layer 158. Thus, in the case of a negatively charged toner cake layer 158, the ion source 160 is preferably provided with an energizing bias at its grid intermediate the potential of the image and non-image areas of the latent image on the latent image carrier member 210. In areas where the latent image is at a potential lower than the bias potential of the charging source grid, the bias potential generates electrostatic field lines in a direction toward the latent image carrier member 210 and toner cake layer 158. Conversely, electrostatic field lines are generated in a direction away from the latent image carrier member 210 and toner cake layer 158 in areas where the latent image is at a potential higher than the bias potential of the charging source grid. The free flowing ions generated by the ion source 160 are captured by toner cake layer 158 in a pattern corresponding to the latent image on the latent image carrier member 210, causing imaged charging of the toner cake layer 158, thereby creating a secondary latent image within the toner cake layer 158 that is charged opposite in charge polarity to the charge of the original latent image. Under optimum conditions, the charge associated with the original latent image will be captured and converted into the secondary latent image in the toner cake layer 158 such that the original electrostatic latent image is substantially or completely dissipated into the toner cake layer 158.

Once the secondary latent image is formed in the toner cake layer 158, the secondary latent image bearing portion of the toner cake layer 158 is advanced to an imaging member 220. Imaging member 220 may be provided in the form of a biased roll member having a surface adjacent to the surface of the latent image carrier resides on latent image carrier member 210. An electrical biasing source 255 is coupled to the imaging member 220 to bias the imaging member 220 so as to attract image areas of the latent image formed in the toner cake layer 158 for simultaneously separating and developing the toner cake layer 158 into image and non-image portions. In the illustrated embodiment, the imaging member 220 is biased with a polarity opposite the charge polarity of the image areas in the toner cake layer 158 for attracting image areas therefrom, thereby producing a developed image made up of selectively separated and transferred portions of the toner cake on the developed image bearing surface 222 of the imaging member 220, while leaving background image byproduct on the latent image carrier member 210. The developed image may then be directly transferred to a copy substrate. In the illustrated embodiment, the developed image is transferred in a single, adhesive transfer step from the developed image bearing surface 222 of the imaging member 220 to a copy substrate 175 carried on the substrate transfer path 170.

Additional details of the construction and operation of the illustrated embodiment of the contact electrostatic printing engine 200 and variations thereof may be found in commonly-assigned U.S. Pat. No. 5,826,147, the disclosure of which is incorporated herein by reference.

Figure 3:
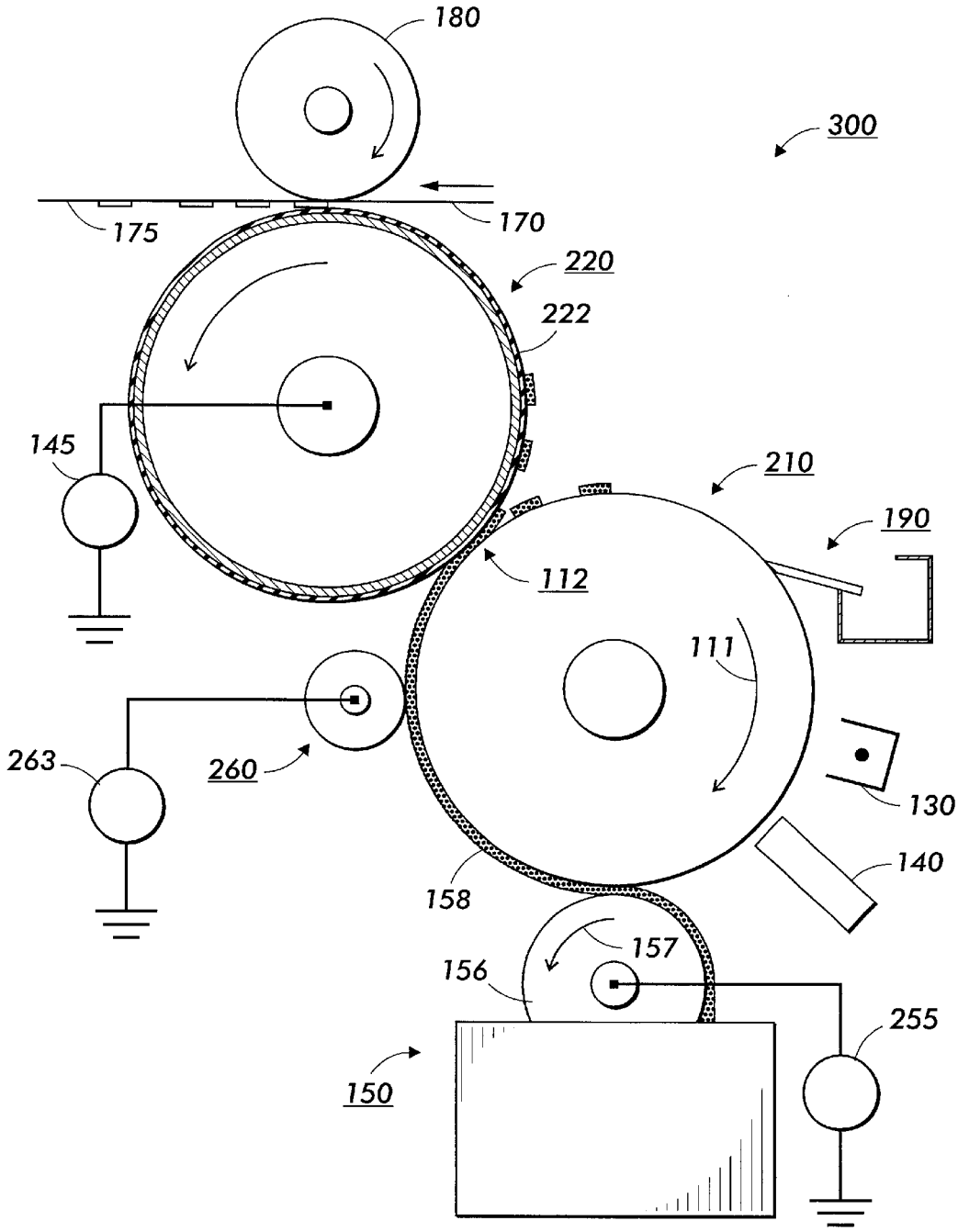
FIG. 3 is an elevational view schematically depicting a third embodiment of a CEP engine constructed for use in a contact electrostatic printing system for imaging and development of an electrostatic latent image, wherein a layer of highly concentrated toner cake on latent image carrier member is selectively charged in a pattern corresponding to an image to create a secondary latent image, and wherein means are provided for inducing air breakdown in the vicinity of the toner cake layer so as to create the secondary latent image.

FIG. 3 is an elevational view schematically depicting a third embodiment of a contact electrostatic printing engine 300 constructed for imaging and development of an electrostatic latent image, wherein a highly concentrated toner cake layer on an imaging member is selectively charged in a pattern corresponding to an image to create a secondary latent image, and wherein means are provided for inducing air breakdown in the vicinity of the toner cake layer so as to better create the secondary latent image.

As illustrated in FIG. 3, the contact electrostatic printing engine 300 may be constructed for operation similar to that described hereinabove with respect to the CEP engine 200, and wherein means are provided for inducing air breakdown in the vicinity of the liquid developing material layer so as to create the secondary latent image, as will now be described.

When two conductors are made proximate with a voltage applied their between, electrical discharge will occur as the voltage is increased to the point of air breakdown. Thus, at a critical threshold voltage, a discharge current occurs in the air gap between the conductors. This critical point is commonly known as the Paschen threshold voltage. When such conductors have a minimal gap (e.g., a few thousandths of an inch), the discharge can occur without arcing, such that a discharge current will be caused to flow across the gap.

As previously described, the primary function of the ion source 160 is to provide free mobile ions in the vicinity of the latent image carrier member 210 having the toner cake layer 158 and latent image so as to induce imaged charging. A biased roll member 260 is coupled to an electrical biasing source 263 capable of providing a voltage potential to the roll member 260 that is sufficient to produce air breakdown in the vicinity of the latent image on the latent image carrier member 210. Preferably, the voltage applied to the roll 260 is maintained at a predetermined potential such that electrical discharge is induced only in a limited region where the surface of the roll member 260 and the latent image carrier member 210 are in very close proximity and the voltage differential between the roll member 260 and the image and/or non-image areas of the latent image exceed the Paschen threshold voltage. To effect that which will be known as "one-way breakdown", it is contemplated that the bias applied to the roll member 260 is sufficient to exceed the Paschen threshold voltage only with respect to either one of the image or non-image areas of the original latent image on the imaging member. Alternatively, to effect that which will be known as "2-way breakdown", the bias applied to the roll member 260 may be sufficient to exceed the Paschen threshold with respect to both the image or non-image areas of the original latent image. The air breakdown induced in these situations will can be caused to occur in a pattern such that field lines are generated in opposite directions with respect to the image and non-image areas.

Accordingly, the imaged charging of a neutrally charged toner cake layer 158 can induce air breakdown in both the pre-nip and post-nip regions to provide the opposite charge polarity ions required to appropriately imaged charge the neutral toner cake layer. Such charging can be enabled by a segmented version of the bias roll member 260, as disclosed generally in U.S. Pat. No. 3,847,478, the disclosure of which is incorporated by reference herein. It will be recognized that the bias voltage applied to the roll member 260 is not required to be between the potentials associated with the image and non-image areas of the original latent image on the imaging member. Rather, a voltage which causes air breakdown relative to only one of either the image or non-image areas need be applied to the roll member.

Additional details of the construction and operation of the illustrated contact electrostatic printing engine 300, and variations thereof, may be found in commonly-assigned U.S. Pat. No. 5,937,243, the disclosure of which is incorporated herein by reference.

Figure 4:
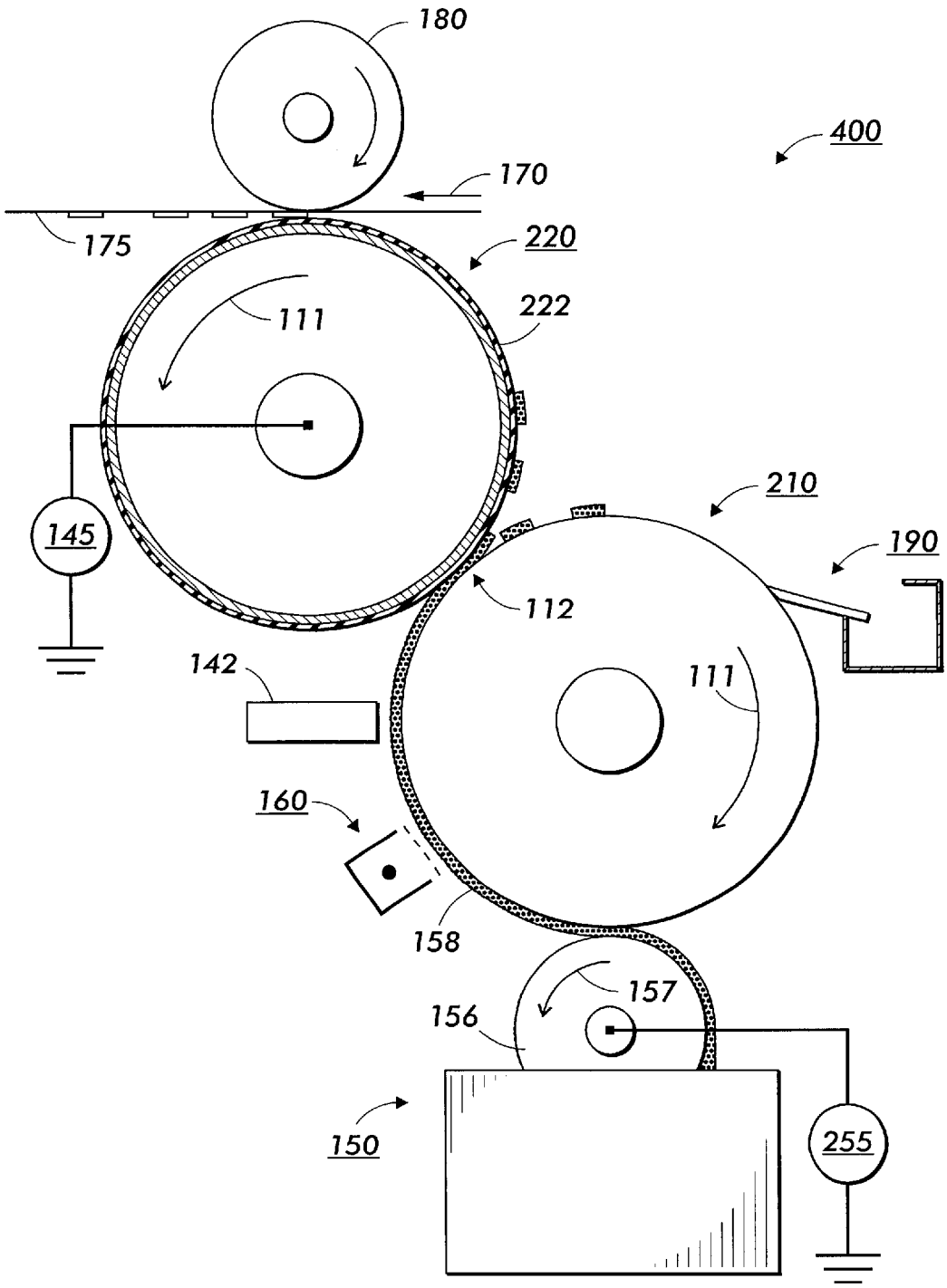
FIG. 4 is an elevational view schematically depicting a fourth embodiment of a CEP engine constructed for use in a contact electrostatic printing for imaging and development of an electrostatic latent image, wherein a uniformly charged layer of highly concentrated toner cake on a latent image carrier member is selectively charged in a pattern corresponding to an image by an ionographic device to create a latent image.

FIG. 4 is an elevational view schematically depicting a fourth embodiment of a contact electrostatic printing engine constructed for imaging and development of an electrostatic latent image, wherein a highly concentrated toner cake layer on an imaging member is selectively charged in a pattern corresponding to an image to create a latent image, and wherein ionographic means are provided for inducing the latent image in the toner cake layer received on the latent image carrier member 210.

As illustrated in FIG. 4, the contact electrostatic printing engine 400 may be constructed for operation similar to that described hereinabove with respect to the engine 200; however, the latent image carrier member 210 is constructed to include a conductive, semiconductive, or dielectric surface. An optional ion source 160 may be employed to uniformly charge the toner cake layer 158. The corona generating device 130 is omitted and an ionographic exposure station 142 is operated to selectively charge the toner cake layer 158 in an imaged fashion to create a latent image. The latent image bearing portion of the toner cake layer 158 is advanced in a process direction 111 to the imaging member 220. The electrical biasing source 145 is coupled to the imaging member 220 to bias the imaging member 220 so as to attract image areas of the latent image formed in the toner cake layer 158 for simultaneously separating and developing the toner cake layer 158 into image and non-image portions. In the illustrated embodiment, the imaging member 220 is biased with a polarity opposite the charge polarity of the image areas in the toner cake layer 158 for attracting image areas therefrom, thereby producing a developed image made up of selectively separated and transferred portions of the toner cake layer 158, while leaving background image byproduct on the surface of the latent image carrier member 210. After the developed image is formed on the developed image bearing surface 222 of the imaging member 220, the developed image undergoes direct adhesive transfer to the copy substrate 175.

As illustrated in FIGS. 1–4, a transfer assembly provided in the form of a pressure roller 180 and electrical biasing source 145 aids in the direct adhesive transfer of the developed image to the copy substrate 175. In the illustrated embodiments, the copy substrate 175 may be provided in the form of a paper sheet, aligned on the substrate path 170, to receive the developed image at a transfer zone located at the interface of the imaging member 120,220 and the copy substrate 175. This developed image transfer is preferably accomplished as direct, single-step adhesive transfer, according to an optimization relationship described below.

In a final step in the operation of the aforementioned engines 100–400, the background image is removed in preparation for a subsequent imaging cycle. FIGS. 1–4 illustrate a simple blade cleaning apparatus 190 as is known in the art. Alternative embodiments may include a brush or roller member for removing toner from the surface on which it resides. The removed toner may be transported to a toner sump or other conservation vessel so that the waste toner can be recycled and used again to generate another toner cake layer 158 in subsequent imaging cycles.

It will be understood that the toner cake delivery apparatus 150 may include ancillary apparatus, such as a metering roll (not shown) situated in close proximity to the surface of the applicator 156, providing a shear force against the low solids content material layer deposited on the surface thereof, for controlling the thickness of the low solids content developing material layer. Thus, a metering roll may optionally be employed to meter a predetermined amount of liquid developing material. The excess material eventually falls away from the metering roll and may be reclaimed.

Turning now to a particular feature of the present invention, adhesive transfer of the developed image, with high transfer efficiency, may be achieved in a single image transfer step by optimization of the following variables:

A1=the extent of adhesion of the developed image to the developed image bearing surface);

C=the extent of cohesion of the developed image, wherein cohesion of the developed image minimizes shearing or splitting of the developed image); and A2=the extent of adhesion of the developed image to the copy substrate.

Optimization is preferably achieved according to the following relationship:

$$A1<C<A2 \quad \text{(Eq.1)}$$

In some embodiments, it will be recognized that the transfer may be effected in ccordance with the registration requirements of a composite color image.

Preferably, the transfer assembly may include a heating device (not shown) for assisting in the pressure transfer and fixing of the developed image on the copy substrate 175, whereby pressure and heat are simultaneously applied to the developed image to simultaneously transfer and at least partially fuse (e.g., transfuse) the developed image to the copy substrate 175. In the embodiments shown in FIGS. 1–4, the pressure roll 180 is heated. Alternatively, or in addition, the copy substrate 175 may be heated. Still other methods that assist in optimization of the cohesive and adhesive properties of the developed image include acoustic stimulation of the developed image, or by the application of ultraviolet energy to ultraviolet-sensitive components of the toner cake layer.

Conditions are optimized at the entrance and exit of the transfer zone such that the developed image is sufficiently cohesive at the entrance to the transfer zone and after being brought into contact with the copy substrate 175.

Particularly preferred embodiments of the imaging member 120, 220 include a developed image bearing surface 122, 222 constructed of an elastomeric material and which exhibits substantial conformability and a low surface energy.

Experimental results indicate that one or more of the following preferred construction or composition details were advantageous in effecting the above-described optimization:

a) A toner cake layer 158 composed of Nucrel ethylene acid copolymer resin (DuPont Packaging and Industrial Polymers, Wilmington, Del.) and Isopar H or L high purity iso-paraffinic solvents (ExxonMobil Chemical, Edison, N.J.) having greater than 20 percent solids by weight for mass densities of 0.1 to 0.25 mg/cm$^2$.

b) Developed image bearing surfaces 122, 222 having materials that exhibit a bulk surface energy value less than approximately 30 dyne/cm. Useful results have been achieved using a developed image bearing surface constructed of 5 mil layer of Viton B50 fluoroelastomer (DuPont Dow Elastomers L.L.C., Wilmington, Del.) on a 3.5 mil Kapton polyimide layer (DuPont High Performance Films, Circleville, Ohio). Alternative elastomeric materials include Kalrez perfluoroelastomer (DuPont Dow Elastomers L.L.C., Wilmington, Del.) and silicone.

c) A dwell time in the transfer nip of approximately 20–30 milliseconds.

d) An average transfer nip pressure of 50–250 pounds per square inch.

e) A preheated copy substrate, having a temperature in the range of 270 degrees F. to 450 degrees F., or preheating the portion of the toner cake layer having the developed image to a temperature in the range of spacebar 350 degrees F. to 450 degrees F.

f) A toner cake layer 158 exhibiting a sufficiently high yield stress to substantially eliminate lateral movement of the toner particles in the toner cake layer 158 when exposed to compression stresses generated at the entrance to and in the nip 112, while also having sufficiently low yield stress to permit the toner layer to act as a liquid in the presence of tensile stress forces present in the vicinity of the exit of the nip 112.

In general, further definition of operational parameters for optimization of the contact electrostatic printing process, via pre-selecting materials having a particular yield stress and/or selectively varying the yield stress of a given liquid developing material, may be determined by those skilled in the art so as to pre-select the materials making up the liquid developing material, the toner particle concentration of the liquid developing material, and the electrical field strength generated between the biased layer applicator on one surface and the electrostatic latent image on a second surface.

Exemplary marking material colors in the respective low solids content liquid developing materials are selectable as known in the art, e.g., cyan, magenta, yellow, and black; however, other component colors may be employed. It is contemplated that a contact electrostatic printing system would employ at least one of the illustrated CEP engines. Furthermore, the liquid developing material operable in the CEP engine may be distinguishable according to one or more physical characteristics in addition to, or other than, the color of the marking material, and nonetheless such engines are encompassed by the present invention.

The liquid carrier medium utilized in the low solids content developing material may be selected from a wide variety of materials, including, but not limited to, any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, and including isoparaffinic hydrocarbons such as Isopar® G, H, L, and N, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons provide a preferred liquid media, since they are colorless, environmentally safe. These particular hydrocarbons may also possess a sufficiently high vapor pressure so that a thin film of the liquid evaporates from the contacting surface within seconds at ambient temperatures.

The marking material (toner) particles can comprise any particulate material that is compatible with the liquid carrier medium, such as those contained in the liquid developing materials disclosed in, for example, U.S. Pat. Nos. 3,729,419; 3,841,893; 3,968,044; 4,476,210; 4,707,429; 4,762,764; 4,794,651; and 5,451,483, among others. Preferably, the marking material particles should have an average particle diameter ranging from about 0.2 to about 10 microns, and most preferably between about 0.5 and about 2 microns. The marking material particles can consist solely of pigment particles, or may comprise a resin and a pigment; a resin and a dye; or a resin, a pigment, and a dye or resin alone.

Suitable resins include poly(ethyl acrylate-co-vinyl pyrrolidone), poly(N-vinyl-2-pyrrolidone), and the like, including, for example Elvax®, and/or Nucrel®, available from E.I. DuPont de Nemours & Co. of Wilmington, Del. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, and the like, all available from Sandoz Company, Mississauga, Ontario, among other manufacturers; as well as the numerous pigments listed and illustrated in U.S. Pat. Nos. 5,223,368; 5,484,670, the disclosures of which are totally incorporated herein by reference. Dyes generally are present in an amount of from about 5 to about 30 percent by weight of the toner particle, although other amounts may be present provided that the objectives of the present invention are achieved.

Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF); as well as the numerous pigments listed and illustrated in U.S. Pat. Nos. 5,223,368; 5,484,670, the disclosures of which are incorporated herein by reference. Generally, any pigment material is suitable provided that it consists of small particles that combine well with any polymeric material also included in the developer composition. Pigment particles are generally present in amounts of from about 5 to about 60 percent by weight of the toner particles, and preferably from about 10 to about 30 percent by weight.

In addition to the liquid carrier vehicle and toner particles which typically make up the liquid developer materials, a charge director (sometimes referred to as a charge control additive) may also be provided for facilitating and maintaining a uniform charge on the marking particles in the operative solution of the liquid developing material by imparting an electrical charge of selected polarity (positive or negative) to the marking particles. Examples of suitable charge director compounds include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight of solids, and preferably from about 0.02 to about 0.05 percent by weight of solids of the developer composition.

What is claimed is:

1. An imaging system for effecting contact electrostatic printing of an image, having at least one contact electrostatic printing engine operable upon a copy substrate, wherein the printing engine comprises:

an imaging station for generating a latent image;

a latent image carrier member having a latent image bearing surface for carrying the latent image;

an imaging member having a developed image bearing surface;

a toner cake layer delivery apparatus operable for delivering a toner cake layer to at least one of the developed image bearing surface and the latent image bearing surface;

wherein the latent image carrier member and the imaging member are operable for engagement of the latent image bearing surface with the developed image bearing surface at a development nip, the toner cake layer being thereby separated, in correspondence with the image and non-image regions of the latent image, into a developed image on the developed image bearing surface and a background on the latent image bearing surface; and a transfer assembly for impressing the copy substrate upon the developed image borne by the developed image bearing surface, so as to effect direct adhesive transfer of the developed image at a transfer nip to the copy substrate, the direct adhesive transfer being effected according to the following:

$$A1<C<A2 \quad \text{(Eq.1)}$$

wherein A1 represents the extent of adhesion of the developed image to the developed image bearing surface; C represents the extent of cohesion of the developed image, the extent of cohesion being sufficient to resist shearing or splitting of the developed image; and A2 represents the extent of adhesion of the developed image to the copy substrate.

2. The imaging system of claim 1, wherein the printing engine is operable for providing the toner cake layer on the developed image bearing surface, and wherein the imaging station further comprises means for charging the latent image bearing surface in an image-wise fashion to create the latent image, and wherein the engagement of the developed image bearing surface with the latent image bearing surface at the development nip causes the d eveloped image to be created on the developed image bearing surface by separation of the toner cake layer, and wherein non-image regions are transferred to the latent image carrier member.

3. The imaging system of claim 1, wherein the printing engine is ioperable for providing the toner cake layer on the latent image bearing surface, and wherein the imaging station further comprises means for charging the latent image bearing surface in an image-wise fashion to create the latent image, and wherein the engagement of the developed image bearing surface with the latent image bearing surface at the development nip causes selective portions of the toner cake layer to be transferred to the developed image bearing surface in correspondence with the image, and non-image regions to remain on the latent image carrier member.

4. The imaging system of claims 3, wherein the imaging station further comprises an exposure device for generating a primary electrostatic latent image on the latent image bearing surface, wherein the primary electrostatic latent image includes image areas defined by a first charge voltage and non-image areas defined by a second charge voltage distinguishable from the first charge voltage, the toner cake layer on the surface of the latent image carrier member being adjacent the primary electrostatic latent image, and further comprising a charge source for selectively delivering charges to the toner cake layer in a pattern corresponding to the primary electrostatic latent image, so as to form a secondary latent image in the toner cake layer, and wherein the developed image bearing surface is operable for engagement with the latent image carrier member for selectively receiving portions of the toner cake layer in accordance with the secondary latent image.

5. The imaging system of claim 4, further comprising a charger for inducing air breakdown in the vicinity of the toner cake layer for improved creation of the secondary latent image.

6. The imaging system of claim 4, further comprising an ionographic source operable for selectively delivering charges to the toner cake layer in a pattern corresponding to the primary electrostatic latent image, so as to form the secondary latent image.

7. The imaging system of claim 1, wherein the toner cake layer includes at least one of the following characteristics: a high solids content in the range of approximately 10–50 percent solids, a uniform thickness in the range of less than 15 microns, and a metered mass per unit area of approximately 0.1 mg per $cm^2$.

8. The imaging system of claim 1, wherein the latent image bearing surface further comprises a photosensitive imaging substrate.

9. The imaging system of claim 1, wherein the developed image bearing surface further comprises at least one of the following surface characteristics: substantial conformability, low surface energy, and electrical conductivity.

10. The imaging system of claim 1, wherein the developed image bearing surface further comprises an elastomeric material.

11. The imaging system of claim 1, wherein the developed image bearing surface exhibits a bulk surface energy value of less than approximately 30 dyne/cm.

12. The imaging system of claim 1, wherein the transfer assembly further comprises a heated pressure roller.

* * * * *